US007666560B2

(12) United States Patent
Mishra et al.

(10) Patent No.: US 7,666,560 B2
(45) **Date of Patent: *Feb. 23, 2010**

(54) IMAGING MEMBER

(75) Inventors: Satchidanand Mishra, Webster, NY (US); Anthony M. Horgan, Pittsford, NY (US); Kent Evans, Lima, NY (US); George Liebermann, Mississauga (CA); Kathleen M. Carmichael, Williamson, NY (US); Dennis J. Prosser, Walworth, NY (US); Richard L. Post, Penfield, NY (US); Edward Domm, Hilton, NY (US); Johann Junginger, Toronto (CA); Michael Zak, Canandaigua, NY (US)

(73) Assignee: Xerox Corporation, Norwalk, CT (US)

( * ) Notice: Subject to any disclaimer, the term of this patent is extended or adjusted under 35 U.S.C. 154(b) by 681 days.

This patent is subject to a terminal disclaimer.

(21) Appl. No.: 11/158,119

(22) Filed: Jun. 21, 2005

(65) Prior Publication Data

US 2006/0286471 A1 Dec. 21, 2006

(51) Int. Cl.
*G03G 5/047* (2006.01)

(52) U.S. Cl. ..... 430/58.8; 430/58.05; 430/58.65; 430/58.75; 430/134

(58) Field of Classification Search ..... 430/58.05, 430/58.65, 58.75, 58.8, 133, 134, 66, 67
See application file for complete search history.

(56) References Cited

U.S. PATENT DOCUMENTS

| | | | | |
|---|---|---|---|---|
| 3,121,006 | A | | 2/1964 | Middleton et al. |
| 4,233,384 | A | | 11/1980 | Turner et al. |
| 4,265,990 | A | | 5/1981 | Stolka et al. |
| 4,286,033 | A | | 8/1981 | Neyhort et al. |
| 4,291,110 | A | | 9/1981 | Lee |
| 4,299,897 | A | | 11/1981 | Stolka et al. |
| 4,306,008 | A | | 12/1981 | Pai et al. |
| 4,338,387 | A | | 7/1982 | Hewitt |
| 4,424,267 | A | * | 1/1984 | Kondo et al. ..... 430/66 |
| 4,439,507 | A | | 3/1984 | Pan et al. |
| 4,587,189 | A | | 5/1986 | Hor et al. |
| 4,664,995 | A | | 5/1987 | Horgan et al. |
| 4,988,597 | A | | 1/1991 | Spiewak et al. |
| 5,055,366 | A | * | 10/1991 | Yu et al. ..... 430/58.8 |
| 5,244,762 | A | | 9/1993 | Spiewak et al. |
| 5,308,727 | A | | 5/1994 | Osawa et al. |
| 5,473,064 | A | | 12/1995 | Maya et al. |
| 5,521,043 | A | | 5/1996 | Listigovers et al. |
| 5,571,649 | A | | 11/1996 | Mishra et al. |
| 5,576,130 | A | | 11/1996 | Yu et al. |
| 5,591,554 | A | | 1/1997 | Mishra et al. |
| 5,607,802 | A | | 3/1997 | Mishra et al. |
| 5,703,487 | A | | 12/1997 | Mishra |
| 5,830,614 | A | | 11/1998 | Pai et al. |
| 6,008,653 | A | | 12/1999 | Popovic et al. |
| 6,015,645 | A | | 1/2000 | Murti et al. |
| 6,068,960 | A | | 5/2000 | Pai et al. |
| 6,119,536 | A | | 9/2000 | Popovic et al. |
| 6,127,077 | A | * | 10/2000 | Pai et al. ..... 430/58.7 |
| 6,214,514 | B1 | | 4/2001 | Evans et al. |
| 6,255,027 | B1 | | 7/2001 | Wehelie et al. |
| 6,294,300 | B1 | | 9/2001 | Carmichael et al. |
| 6,350,550 | B1 | | 2/2002 | Mishra et al. |
| 6,379,853 | B1 | * | 4/2002 | Lin et al. ..... 430/58.45 |
| 7,413,835 | B2 | * | 8/2008 | Lin et al. ..... 430/58.05 |
| 7,459,251 | B2 | * | 12/2008 | Mishra et al. ..... 430/64 |
| 2004/0096761 | A1 | | 5/2004 | Lin et al. |
| 2004/0115544 | A1 | | 6/2004 | Fu et al. |
| 2004/0115545 | A1 | | 6/2004 | Horgan et al. |
| 2004/0126684 | A1 | | 7/2004 | Horgan et al. |
| 2004/0197685 | A1 | | 10/2004 | Ioannidis et al. |

OTHER PUBLICATIONS

Diamond, A. S., ed., Handbook of Imaging Materials, Marcel Dekker, Inc, NY (1991), pp. 395-396.*
Diamond, A.S., ed., Handbook of Imaging Materials, Marcel Dekker, Inc., NY (1991), pp. 428 and 430.*

* cited by examiner

*Primary Examiner*—Janis L Dote
(74) *Attorney, Agent, or Firm*—Fay Sharpe LLP

(57) ABSTRACT

An imaging member includes a charge generating layer and a charge transport layer. The charge transport layer includes a first surface in contact with the charge generating layer and a second surface. The charge transport layer includes a film forming polymer binder and a charge transport component dispersed therein. The concentration of the charge transport component in the charge transport layer is at a peak in a region of the charge transport intermediate the first and second surfaces of the charge transport layer.

12 Claims, 3 Drawing Sheets

IMAGING MEMBER

BACKGROUND

There is disclosed herein an imaging member used in electrophotography having a charge transport layer with multiple concentrations of charge transport components. More particularly disclosed herein is an imaging member that has a photogenerating layer and a charge transport layer with one or more regions or layers. In each region or layer, the charge transport components are molecularly dispersed or dissolved in a polymer binder to form a solid solution. In the resulting charge transport layer, the region or layer closest in proximity to the photogenerating layer is in contiguous contact therewith and comprises a lower concentration of charge transport components than a layer spaced from the photogenerating layer.

A typical electrophotographic imaging member is imaged by uniformly depositing an electrostatic charge on an imaging surface of the electrophotographic imaging member and then exposing the imaging member to a pattern of activating electromagnetic radiation, such as light, which selectively dissipates the charge in the illuminated areas of the imaging member while leaving behind an electrostatic latent image in the non-illuminated areas, This electrostatic latent image may then be developed to form a visible image by depositing finely divided electroscopic marking toner particles on the imaging member surface. The resulting visible toner image can then be transferred to a suitable receiving member, such as paper.

A number of current electrophotographic imaging members are multilayered photoreceptors that, in a negative charging system, comprise a substrate support, an electrically conductive layer, an optional charge blocking layer, an optional adhesive layer, a charge generating layer, a charge transport layer, and optional protective or overcoating layer(s). The multilayered photoreceptors can take several forms, for example, flexible belts, rigid drums, flexible scrolls, and the like. Flexible photoreceptor belts may either be seamed or seamless belts. An anti-curl layer may be employed on the back side of the flexible substrate support, the side opposite to the electrically active layers, to achieve a desired photoreceptor belt flatness.

Although excellent toner images may be obtained with multilayered belt photoreceptors, a delicate balance in charging image and bias potentials, and characteristics of toner/developer must be maintained. This places additional constraints on photoreceptor manufacturing, and thus, on the manufacturing yield. Localized microdefect sites, varying in size of from about 5 to about 200 microns, can sometimes occur in manufacture, which appear as print defects (microdefects) in the final imaged copy. In charged area development, where the charged areas are printed as dark areas, the sites print out as white spots. These microdefects are called microwhite spots. In discharged area development systems, where the exposed area (discharged area) is printed as dark areas, these sites print out as dark spots on a white background. All of these microdefects, which exhibit inordinately large dark decay, are called charge deficient spots (CDS). Since the microdefect sites are fixed in the photoreceptor, the spots are registered from one cycle of belt revolution to next. Charge deficient spots have been a serious problem for a very long time in many organic photoreceptors, such as multilayered benzimidazole perylene photoreceptors where the perylene pigment is dispersed in a matrix of a bisphenol Z type polycarbonate film forming binder.

Whether these localized microdefect or charge deficient spot sites will show up as print defects in the final document depends, to some degree, on the development system utilized and, thus, on the machine design selected. For example, some of the variables governing the final print quality include the surface potential of photoreceptor, the image potential of the photoreceptor, photoreceptor to development roller spacing, toner characteristics (such as size, charge, and the like), the bias applied to the development rollers and the like. The image potential depends on the light level selected for exposure. The defect sites are discharged, however, by the dark discharge rather than by the light. The copy quality from generation to generation is maintained in a machine by continuously adjusting some of the parameters with cycling. Thus, defect levels may also change with cycling.

Techniques have been developed for the detection of CDS's. These have largely involved destructive testing, although some contactless methods have been developed. Additionally, multilayer imaging members have been developed to block charge injection from the substrate which can give rise to CDS's.

CROSS REFERENCE TO RELATED APPLICATIONS

The following applications, the disclosures of each being totally incorporated herein by reference, are mentioned:

U.S. application Ser. No. 10/744,369, filed Dec. 23, 2003, entitled "Imaging Members," by Satchidanand Mishra, et al. discloses a charge transport layer in which the concentration of a charge transport component decreases, such as by a decreasing concentration gradient, from the lower surface to an upper surface in the charge transport layer.

U.S. application Ser. No. 10/736,864, filed Dec. 16, 2003, entitled "Imaging Members," by Anthony M. Horgan, et al. discloses a charge transport layer of an imaging member which includes a plurality of charge transport layers coated from solutions of similar or different compositions or concentrations, wherein the upper or additional transport layer or layers comprise a lower concentration of charge transport component than the first (bottom) charge transport layer.

U.S. application Ser. No. 10/320,808, filed Dec. 16, 2002, entitled "Imaging Members," by Anthony M. Horgan et al discloses a dual charge transport layer in which the top layer comprises a hindered phenol dopant.

INCORPORATION BY REFERENCE

The following patents, the disclosures of which are incorporated in their entireties by reference, are mentioned:

Electrophotographic imaging members having at least two electrically operative layers including a charge generating layer and a transport layer comprising a diamine are disclosed in U.S. Pat. Nos. 4,265,990, 4,233,384, 4,306,008, 4,299,897, and 4,439,507.

U.S. Pat. No. 5,830,614 relates to a photoreceptor which comprises a support layer, a charge generating layer, and two charge transport layers. A first of the charge transport layers consists of charge transporting polymer comprising a polymer segment in direct linkage to a charge transporting segment and a second transport layer comprises a charge transporting polymer as for the first layer, except that it has a lower weight percent of the charge transporting segment than that of the first charge transport layer.

U.S. Pat. No. 6,294,300 discloses a photoconductor which includes a charge transport layer coated over a charge generator layer. A hole transport molecule is intentionally added to the charge generator layer preventing migration of hole transport molecules from the charge transport layer to the charge generator layer.

U.S. Pat. Nos. 5,703,487 and 6,008,653 disclose methods for detecting CDS's. In the '487 patent, a process for ascertaining the microdefect levels of an electrophotographic imaging member includes measuring either the differential increase in charge over and above the capacitive value or measuring reduction in voltage below the capacitive value of a known imaging member and of a virgin imaging member and comparing differential increase in charge over and above the capacitive value or the reduction in voltage below the capacitive value of the known imaging member and of the virgin imaging member.

U.S. Pat. No. 6,008,653 discloses a method for detecting surface potential charge patterns in an electrophotographic imaging member with a floating probe scanner. The scanner includes a capacitive probe, which is optically coupled to a probe amplifier, and an outer Faraday shield electrode connected to a bias voltage amplifier. The probe is maintained adjacent to and spaced from the imaging surface to form a parallel plate capacitor with a gas between the probe and the imaging surface. A constant voltage charge is applied to the imaging surface prior to establishing relative movement of the probe and the imaging surface. Variations in surface potential are measured with the probe and compensated for variations in distance between the probe and the imaging surface. The compensated voltage values are compared to a baseline voltage value to detect charge patterns in the electrophotographic imaging member U.S. Pat. Nos. 5,591,554; 5,576,130; and 5,571,649 disclose methods for preventing charge injection from substrates which give rise to CDS's. These patents disclose an electrophotographic imaging member including a support substrate having a two layered electrically conductive ground plane layer comprising a layer comprising zirconium over a layer comprising titanium, a hole blocking layer, and an adhesive layer. The adhesive layer of the '554 patent includes a copolyester film forming resin, and the member further includes an intermediate layer comprising a carbazole polymer, a charge generation layer comprising a perylene or a phthalocyanine, and a hole transport layer, which is substantially non-absorbing in the spectral region at which the charge generation layer generates and injects photogenerated holes. The adhesive layer of the '130 patent comprises a thermoplastic polyurethane film forming resin. The adhesive layer of the '649 patent comprises a polymer blend comprising a carbazole polymer and a film forming thermoplastic resin in contiguous contact with a hole blocking layer.

BRIEF DESCRIPTION

Aspects of the exemplary embodiment relate to an imaging member and a method of formation. In one aspect, the imaging member includes a charge generating layer and a charge transport layer. The charge transport layer includes a first surface in contact with the charge generating layer and a second surface. The charge transport layer includes a film forming polymer binder and a charge transport component dispersed therein. The concentration of the charge transport component in the charge transport layer is at a peak in a region of the charge transport intermediate the first and second surfaces of the charge transport layer.

In another aspect, an imaging member includes an optional substrate, a source of charge, and a charge transport layer which receives charge from the source. The charge transport layer includes a film forming polymer binder and a charge transport component dispersed therein. The charge transport layer includes a first region and a second region. The second region is spaced from the source of charge by the first region. The first region has a lower charge mobility than the second region whereby charge deficient spots are reduced as compared with an imaging member formed without the first region.

In another aspect, a method includes forming a charge transport layer on a charge generating layer, including depositing a first layer on the charge generating layer. The first layer includes a film forming polymer binder and optionally a charge transport component dispersed therein. The method further includes depositing at least one second layer directly or indirectly on the first layer such that the at least one second layer is spaced from the charge generating layer by the first layer, the at least one second layer comprising a film forming polymer binder and a charge transport component dispersed therein, a concentration of charge transport component in the at least one second layer, upon drying, being higher than a concentration of charge transport component in the first layer. A third layer is optionally deposited on the at least one second layer, the third layer comprising a film forming polymer binder and optionally a charge transport component dispersed therein, a concentration of charge transport component in the third layer, upon drying, being lower than a concentration of charge transport component in an adjacent second layer An overcoat layer is optionally deposited over the charge transport layer.

DETAILED DESCRIPTION

Figure 1:
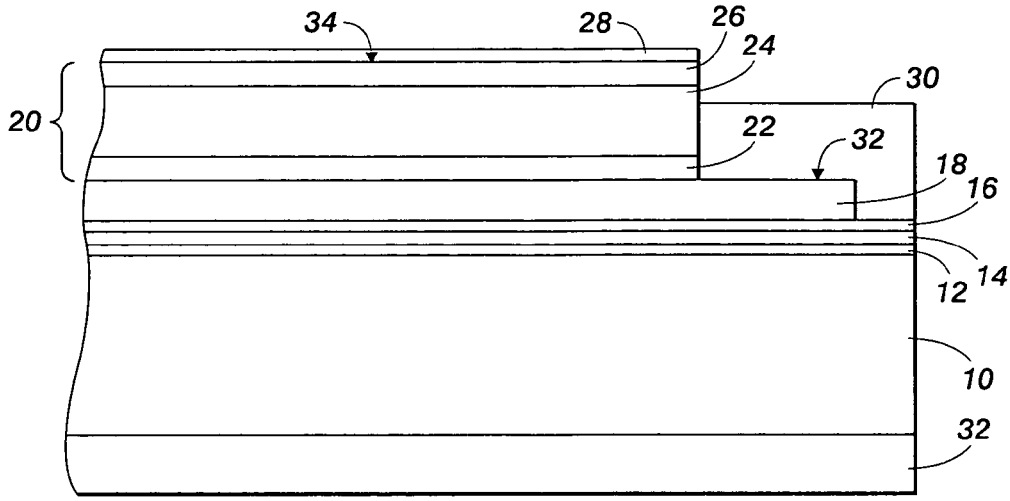
FIG. 1 is a schematic cross sectional view of an exemplary imaging member according to a first embodiment.

Aspects of the exemplary embodiments disclosed herein relate to an imaging member, to a method of formation of an imaging member, and to a method of use of such an imaging member. Although the embodiments disclosed herein are applicable to electrophotographic imaging members in flexible belt configuration and rigid drum form, for reason of simplicity, the discussions below are focused upon electrophotographic imaging members in flexible belt designs.

In aspects of the exemplary embodiment disclosed herein, there is provided an imaging member comprising a photogenerating (charge generating) layer with a charge transport layer disposed thereon. The charge transport layer has a lower surface which is in contiguous contact with the charge generating layer, and an upper surface. Additionally, the charge transport layer comprises a film forming binder and a charge transport component, such as hole transport molecules, molecularly dispersed or dissolved therein to form a solid solution. A first layer of the charge transport layer closest in proximity to the charge generating layer has a lower concentration of charge transport component than a second layer spaced from the charge generating layer. The concentration of the charge transport component in the charge transport layer may increase stepwise, or gradually, as for example, by an increasing concentration gradient, away from the lower surface toward the upper surface. The concentration of the charge transport component may progressively increase from the region closest in proximity to the photogenerating layer and then may decrease toward the upper region of the charge transport layer. While the particular reference is made to the charge transport layer as comprising two or more layers of different concentration of charge transport component, it is to be appreciated that these layers need not be discrete layers but may comprise generally parallel regions of the charge transport layer having different concentrations of charge transport component.

In aspects disclosed herein, the solid solution charge transport layer may have multiple regions of different concentrations of charge transport component. The charge transport layer may comprise a solid solution of different concentrations of charge transport components, film forming polymer binders/resins and other compounds to form two or more regions.

In one aspect, the charge transport layer comprises different regions or layers of a solid solution of a film forming polymer binder containing different concentrations of charge transport component(s) wherein the layer of the largest concentration of charge transport components is spaced from the bottom surface of the charge transport layer and lower concentrations of charge transport components are at the top and bottom surfaces of the charge transport layer.

In a further embodiment, the charge transport layer can comprise multiple charge transport layers consisting of a first or bottom charge transport layer comprising a solid solution of a film forming polymer binder and a charge transport component, and thereover and in contact with the first layer, a second solid solution charge transport layer or layers, spaced from the photogenerating layer by the first layer, the second layer having a higher concentration of charge transport component than the first layer and optionally one or more additional solid solution charge transport layers. The second layer and subsequent additional charge transport layers each can consist of same or different film forming polymer binder and same or different charge transport component as that of the first charge transport layer. However, in the additional layers, the content of charge transport component is reduced in a stepwise, or graduated, concentration gradient from the second layer toward the top or uppermost layer. The additional charge transport layers can comprise from 1 to about 15 layers and, more specifically, from 1 to about 5 layers.

It has been found that the charge injection from a source such as the photogenerating layer, into the charge transport layer is influenced by the number (concentration) of charge transport molecules in the vicinity. By providing a layer which suppresses the migration rate of charge from the charge generating layer into the charge transport layer, CDS spots in images generated by the imaging member can be significantly reduced. Both types of CDS spots can be reduced-discharge development spots, which appear as microblack spots on white backgrounds, and charger development spots, which appear as microwhite spots on dark backgrounds, can be suppressed by lowering the concentration of the charge transport component in the layer adjacent to the charge generation layer. The mobility of the injected charge is also suppressed as a result of the lower concentration of charge transport component. Accordingly, the provision of a second layer which provides a higher charge mobility, for example, by incorporating a higher concentration of charge transport component, spaced from the charge generation layer, facilitates movement of the charge through the charge transport layer overall. Charge mobility can be expressed in terms of average velocity of the charge passing through a unit area per unit field of the imaging member.

The additional charge transport layers in the charge transport layer may also contain a stabilizing antioxidant such as a hindered phenol. Such a phenol is present in the top most layer of the charge transport layer in a reverse concentration gradient to that of the charge transport component. For example, while the concentration of the charge transport component increases from the first or bottom layer (or the layer in closest proximity to the photogenerating layer) and decreases again toward the top layer in the overall charge transport layer, the concentration of the hindered phenol increases near the top surface of the charge transport layer and decreases away from it. Furthermore, in order to achieve enhanced wear resistance results, the top or uppermost layer or region of the charge transport layer may further include particles dispersions of silica, PTFE, and wax polyethylene for effective lubrication and wear life extension or be provided with an overcoat.

Advantages associated with the imaging members of the present exemplary embodiment include for example, a reduction in charge deficient spots (CDS) in images generated with the imaging member. Additional advantages may include the avoidance suppression of early onset of charge transport layer cracking. Such cracking or micro-cracking can be initiated by the interaction with effluent of chemical compounds, such as exposure to volatile organic compounds, like solvents, selected for the preparation of the members and corona emissions from machine charging devices. Such cracking can lead to copy print out defects and also may adversely affect functional characteristics of the imaging member.

Processes of imaging, especially xerographic imaging and printing, including digital printing, are also encompassed by the present disclosure. More specifically, the layered photoconductive imaging members of the present embodiment can be selected for a number of different known imaging and printing processes including, for example, electrophotographic imaging processes, especially xerographic imaging and printing processes wherein charged latent images are rendered visible with toner compositions of an appropriate charge polarity. Moreover, the imaging members disclosed are useful in color xerographic applications, particularly high-speed color copying and printing processes and which members are in embodiments sensitive in the wavelength region of, for example, from about 500 to about 900 nanometers, and in particular from about 650 to about 850 nanometers, thus diode lasers can be selected as the light source.

An exemplary embodiment of the multilayered electrophotographic imaging member of flexible belt configuration is illustrated in FIG. 1. The exemplary imaging member includes an optional support substrate 10 having an optional conductive surface layer or layers 12, an optional hole blocking layer 14, an optional adhesive layer 16, a charge generating layer 18, a charge transport layer 20 having two or more layers or sub-layers, optionally consisting of at least a first charge transport layer 22, a second charge transport layer 24, and a third transport layer 26, and optionally one or more overcoat and/or protective layer(s) 28. Other layers of the imaging member may include, for example, an optional ground strip layer 30, applied to one edge of the imaging member to promote electrical continuity with the conductive layer 12 through the hole blocking layer 14. An anti-curl back coating layer 32 may be formed on the backside of the flexible support substrate. The layers 14, 16, 16, 18, 22, 24, 26, 28 may be separately and sequentially deposited on the substrate 10 as solutions comprising a solvent, with each layer being dried before deposition of the next. Alternatively or additionally, one or more of the layers 24, 26, 28 is applied prior to drying of the previous layer such that partial mixing at the boundaries of adjacent layers and/or leaching diffusion of one or more components from one layer into the adjacent layer (s) can occur.

In the illustrated embodiment, layer 20 has a lower surface 32 which is in direct contact with the upper surface of the charge generating layer 18 and an upper surface 34 which may be the exposed surface of the imaging member if no overcoat layer 28 is employed or, where an overcoat layer 28 or layer is used, the upper surface 34 is in direct contact with the overcoat layer 28.

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like.

The substrate 10 can also be formulated entirely of an electrically conductive material, or it can be an insulating material including inorganic or organic polymeric materials, such as, MYLAR™, a commercially available biaxially oriented polyethylene terephthalate from DuPont, MYLAR™ with a coated conductive titanium surface, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may be flexible, being seamed or seamless for flexible photoreceptor belt fabrication or it can be rigid for use as an imaging member for plate design applications. The substrate may have a number of many different configurations, such as, for example, a plate, a drum, a scroll, an endless flexible belt, and the like. In one embodiment, the substrate is in the form of a seamed flexible belt.

The thickness of the substrate 10 depends on numerous factors, including flexibility, mechanical performance, and economic considerations. The thickness of the support substrate 10 may range from about 50 micrometers to about 3,000 micrometers; and in embodiments of flexible photoreceptor belt preparation, the thickness of substrate 10 is from about 50 micrometers to about 200 micrometers for optimum flexibility and to effect minimum induced photoreceptor surface bending stress when a photoreceptor belt is cycled around small diameter rollers in a machine belt support module, for example, 19 millimeter diameter rollers. The surface of the support substrate is cleaned prior to coating to promote greater adhesion of the deposited coating composition.

An exemplary substrate support 10 is not soluble in any of the solvents used in each coating layer solution, is optically transparent, and is thermally stable up to a high temperature of about 150° C. A typical substrate support 10 used for imaging member fabrication has a thermal contraction coefficient ranging from about $1\times10^{-5}$/° C. to about $3\times10^{-5}$/° C. and a Young's Modulus of between about $5\times10^{5}$ psi ($3.5\times10^{4}$ Kg/cm$^2$) and about $7\times10^{5}$ psi ($4.9\times10^{4}$ kg/cm$^2$).

The conductive layer 12 may vary in thickness depending on the optical transparency and flexibility desired for the electrophotographic imaging member. When a photoreceptor flexible belt is desired, the thickness of the conductive layer 12 on the support substrate 10, for example, a titanium and/or zirconium conductive layer produced by a sputtered deposition process, typically ranges from about 20 Angstroms to about 750 Angstroms to enable adequate light transmission for proper back erase, and in embodiments from about 100 Angstroms to about 200 Angstroms for an optimum combination of electrical conductivity, flexibility, and light transmission. The conductive layer 12 may be an electrically conductive metal layer which may be formed, for example, on the substrate by any suitable coating technique, such as a vacuum depositing or sputtering technique. Typical metals suitable for use as conductive layer 12 include aluminum, zirconium, niobium, tantalum, vanadium, hafnium, titanium, nickel, stainless steel, chromium, tungsten, molybdenum, combinations thereof, and the like. Where the entire substrate is an electrically conductive metal, the outer surface thereof can perform the function of an electrically conductive layer and a separate electrical conductive layer may be omitted.

A positive charge (hole) blocking layer 14 may then optionally be applied to the substrate 10 or to the layer 12, where present. Generally, electron blocking layers for positively charged photoreceptors allow the photogenerated holes in the charge generating layer 18 at the surface of the photoreceptor to migrate toward the charge (hole) transport layer below and reach the bottom conductive layer during the electrophotographic imaging processes. Thus, an electron blocking layer is normally not expected to block holes in positively charged photoreceptors, such as, photoreceptors coated with a charge generating layer over a charge (hole) transport layer. Any suitable hole blocking layer capable of forming an effective barrier to holes injection from the adjacent conductive layer 12 into the photoconductive or photogenerating layer may be utilized. The charge (hole) blocking layer may include polymers, such as, polyvinylbutyral, epoxy resins, polyesters, polysiloxanes, polyamides, polyurethanes, HEMA, hydroxypropyl cellulose, polyphosphazine, and the like, or may comprise nitrogen containing siloxanes or silanes, nitrogen containing titanium or zirconium compounds, such as, titanate and zirconate. Hole blocking layers having a thickness in wide range of from about 50 Angstroms (0.005 micrometers) to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino) titanate, isopropyl trianthranil titanate, isopropyl tri(N,N-dimethylethy[amino)titanate, titanium-4-amino benzene sulfonate oxyacetate, titanium 4-aminobenzoate isostearate oxyacetate, $[H_2N(CH_2)_4]CH_3Si(OCH_3)_2$, (gammaaminobutyl)-methyl diethoxysilane, and $[H_2N(CH_2)_3]CH_33Si(OCH_3)_2$, (gammaaminopropyly)-methyl diethoxysilane, and combinations thereof, as disclosed in U.S. Pat. Nos. 4,338,387, 4,286,033 and 4,291,110, incorporated herein by reference in their entireties. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of these U.S. patents are incorporated herein by reference in their entireties.

The blocking layer 14 is continuous and may have a thickness of less than about 10 micrometers because greater thicknesses may lead to undesirably high residual voltage. In aspects of the exemplary embodiment, a blocking layer of from about 0.005 micrometers to about 2 micrometers facilitates charge neutralization after the exposure step and optimum electrical performance is achieved. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

The optional adhesive layer 16 may be applied to the hole blocking layer 14. Any suitable adhesive layer may be utilized. One well known adhesive layer includes a linear saturated copolyester reaction product of four diacids and ethylene glycol. This linear saturated copolyester consists of alternating monomer units of ethylene glycol and four randomly sequenced diacids in the above indicated ratio and has a weight average molecular weight of about 70,000. If desired, the adhesive layer may include a copolyester resin. The adhesive layer is applied directly to the hole blocking layer. Thus, the adhesive layer in embodiments in direct contiguous contact with both the underlying hole blocking layer and the overlying charge generating layer to enhance adhesion bonding to provide linkage. In embodiments, the adhesive layer is continuous.

Any suitable solvent or solvent mixtures may be employed to form a coating solution of the polyester. Typical solvents include tetrahydrofuran, toluene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive layer 16 may have a thickness of from about 0.01 micrometers to about 900 micrometers after drying. In embodiments, the dried thickness is from about 200 micrometers and about 900 micrometers, although thicknesses of from about 0.03 micrometers to about 1 micrometer are satisfactory for some applications. At thicknesses of less than about 0.01 micrometers, the adhesion between the charge generating layer and the blocking layer is poor and delamination can occur when the photoreceptor belt is transported over small diameter supports such as rollers and curved skid plates.

The photogenerating (charge generating) layer 18 may thereafter be applied to the blocking layer 14 or adhesive layer 16, if one is employed. To create a functional charge transport layer, charge transport molecules may be added to a polymeric matrix to make it electrically active, since the polymer material is itself inherently incapable of supporting the injection of photogenerated holes and incapable of allowing the transport of these holes through it. Any suitable charge generating binder layer 18 including a photogenerating/photoconductive material, which may be in the form of particles and dispersed in a film forming binder, such as an inactive resin, may be utilized. Examples of photogenerating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigment such as the X-form of metal free phthalocyanine, metal phthalocyanines such as vanadyl phthalocyanine and copper phthalocyanine, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. The photogenerating materials selected should be sensitive to activating radiation having a wavelength between about 600 450 and about 700 to 850 nm during the imagewise radiation exposure step in an electrophotographic imaging process to form an electrostatic latent image.

Any suitable inactive resin materials may be employed in the photogenerating layer 18, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like.

The photogenerating material can be present in the resinous binder composition in various amounts. Generally, from about 5 percent by volume to about 90 percent by volume of the photogenerating material is dispersed in about 10 percent by volume to about 95 percent by volume of the resinous binder, and more specifically from about 20 percent by volume to about 30 percent by volume of the photogenerating material is dispersed in about 70 percent by volume to about 80 percent by volume of the resinous binder composition.

The photogenerating layer 18 containing the photogenerating material and the resinous binder material generally ranges in thickness of from about 0.1 micrometer to about 5 micrometer for example, from about 0.3 micrometers to about 3 micrometers when dry. The photogenerating layer thickness is generally related to binder content. Higher binder content compositions generally employ thicker layers for photogeneration.

The charge transport layer 20 is thereafter applied over the charge generating layer 18 and may include any suitable transparent organic polymer or non-polymeric material capable of supporting the injection of photogenerated holes or electrons from the charge generating layer 18 and capable of allowing the transport of these holes through the charge transport layer to selectively discharge the surface charge on the imaging member surface. In one embodiment, the charge transport layer 20 not only serves to transport holes, but also protects the charge generating layer 18 from abrasion or chemical attack and may therefore extend the service life of the imaging member. The charge transport layer 20 can be a substantially non-photoconductive material, but one which supports the injection of photogenerated holes from the charge generation layer 18. In one embodiment the charge transport layer is free or substantially free of photogenerating materials (e.g., layers 22, 24, and 26 each contain less than 1% of the concentration of photogenerating materials in the charge generating layer 18 and in one embodiment, less than 0.01% thereof). The layers or sub-layers 22, 24, 26 of the overall charge transport layer 20 are normally transparent in a wavelength region in which the electrophotographic imaging member is to be used when exposure is effected therethrough to ensure that most of the incident radiation is utilized by the underlying charge generating layer 18. Each charge transport layer should exhibit excellent optical transparency with negligible light absorption and neither charge generation nor discharge if any, when exposed to a wavelength of light useful in xerography, e.g., 4000 to 9000 Angstroms. In the case when the photoreceptor is prepared with the use of a transparent substrate 10 and also a transparent conductive layer 12, imagewise exposure or erase may be accomplished through the substrate 10 with all light passing through the back side of the substrate. In this case, the materials of the layers or sub-layers 22, 24, and 26 need not transmit light in the wavelength region of use if the charge generating layer 18 is sandwiched between the substrate and the charge transport layer 20. The charge transport layer 20 in conjunction with the charge generating layer 18 is an insulator to the extent that an electrostatic charge placed on the charge transport layer is not conducted in the absence of illumination. The first or bottom charge transport layer 22 and the intermediate and top charge transport layers 24, 26 should trap minimal charges as the case may be passing through it. Charge transport layer materials are well known in the art.

The charge transport layer 20 may include any suitable charge transport component or activating compound useful as an additive molecularly dispersed in an electrically inactive polymeric material to form a solid solution and thereby making this material electrically active. The charge transport component may be added to a film forming polymeric material which is otherwise incapable of supporting the injection of photogenerated holes from the generation material and incapable of allowing the transport of these holes therethrough. This converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The charge transport component typically comprises small molecules of an organic compound which cooperate to transport charge between molecules and ultimately to the surface of the charge transport layer.

Although the film forming polymer binder used may be different for different charge transport layers 22, 24, 26 in one embodiment, an identical polymer binder is used throughout the charge transport layer 20 which tends to provide improved interfacial adhesion bonding between the sub-layers 22, 24, 26.

Any suitable inactive resin binder soluble in methylene chloride, chlorobenzene, or other suitable solvent may be employed in the charge transport layer. Exemplary binders include polyesters, polyvinyl butyrals, polycarbonates, polystyrene, polyvinyl formals, and combinations thereof. The polymer binder used for the charge transport layers may be, for example, selected from the group consisting of polycarbonates, polyester, polyarylate, polyacrylate, polyether, polysulfone, combinations thereof, and the like. Exemplary polycarbonates include poly(4,4'-isopropylidene diphenyl carbonate), poly(4,4'-diphenyl-11'-cyclohexene carbonate), and combinations thereof. The molecular weight of the binder can be for example, from about 20,000 to about 1,500,000. One exemplary binder of this type a MAKROLON™ binder, which is available from Bayer AG and comprises poly(4,4'-isopropylidene diphenyl) carbonate having a weight average molecular weight of about 120,000.

Exemplary charge transport components include those described in above-mentioned co-pending application Ser. Nos. 10/736,864, 10/744,369, and 10/320,808, incorporated herein by reference, which may be used singly or in combination for layers 22 and 24. Exemplary charge transporting components include aromatic diamines, such as aryl diamines. The charge transport component can comprise an aryl amine selected from the group consisting of diphenyl diamines, triphenyl amines, terphenyl diamines, and combinations thereof. Exemplary diphenyl diamines suited for use as the charge component, singly or in combination, are represented by the molecular Formula I below:

FORMULA 1

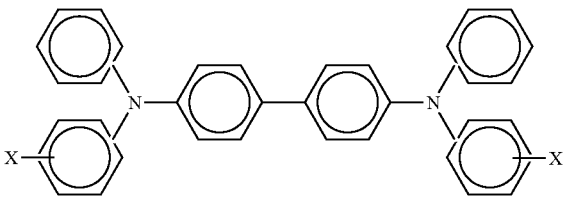

wherein each X is independently selected from the group consisting of alkyl, hydroxy, and halogen. Typically, the halogen is a chloride. Where X is alkyl, X can comprise from 1 to about 10 carbon atoms, e.g., from 1 to 5 carbon atoms, such as methyl, ethyl, propyl, butyl, and the like. Exemplary aromatic diamines of this type include N,N'-diphenyl-N,N'-bis(alkylphenyl)-1,1'-biphenyl-4,4-diamines, such as mTBD, which has the formula (N,N'-diphenyl-N,N'-bis[3-methylphenyl]-[1,1-biphenyl]-4,4'-diamine); N,N'-diphenyl-N,N'-bis(chlorophenyl)-1,1'-biphenyl-4,4'-diamine; and N,N'-bis-(4-methylphenyl), N,N'-bis(4-ethylphenyl)-1,1'-3,3 dimethylbiphenyl)-4,4-diamine (Ae-16), and combinations thereof.

Other layers such as conventional ground strip layer 30 including, for example, conductive particles dispersed in a film forming binder may be applied to one edge of the imaging member to promote electrical continuity with the conductive layer 12 through the hole blocking layer 14, and adhesive layer 16. Ground strip layer 30 may include any suitable film forming polymer binder and electrically conductive particles. Typical ground strip materials include those enumerated in U.S. Pat. No. 4,664,995, the entire disclosure of which is incorporated by reference herein. The ground strip layer 28 may have a thickness from about 7 micrometers to about 42 micrometers, for example, from about 14 micrometers to about 23 micrometers. Optionally, an overcoat layer 26, if desired, may also be utilized to provide imaging member surface protection as well as improve resistance to abrasion and scratching.

In one embodiment, the charge transport layer 20 comprises multiple concentration regions of a binary solid solution comprising a film forming polymer binder and a charge transport component comprising one or more aromatic amine hole transporting compounds according to Formula I or any other suitable aromatic amine of the type disclosed herein. The first layer 22, closest to the charge generating layer 18, has a lower concentration of charge transport component than layer 24 and may comprise, for example, at least about 5 weight percent and may comprise up to about 40 weight percent of charge transport component, e.g., from about 10 to about 35 wt %. All charge transport component concentrations are expressed by weight of the dried layer, unless otherwise indicated. The second layer 24, spaced from the charge generation layer by the first layer, has a higher concentration of charge transport component than the first layer, such that the mobility of charge in the second layer is higher than in the first layer. The second layer 24, may comprise, for example, at least about 30 weight percent and may comprise up to about 90 weight percent of charge transport component, e.g., from about 35 to about 50 wt %. The concentration of the charge transport component in the first layer can be from about 1% to about 95% of the concentration of the charge transport component in the second layer, expressed by weight. In one embodiment, the charge transport component concentration in the first layer is at least about 5% of that of the second layer, in another embodiment, at least about 20%, and in yet another embodiment, at least 30%, In one embodiment, the charge transport component concentration in the first layer is less than about 90% of that of the second layer, in another embodiment, less than about 80%, and in yet another embodiment, about 60% or less of that of the second layer. At low concentration ratios, the effects of the low concentration of the charge transport component in the first layer 22 on the charge mobility can be offset by making layer 22 of a lower thickness than layer 24.

The ratio of charge mobility in the second layer 24 to that in the first layer can 22 be, for example, from about 5:1 to about 100:1.

The first layer 22 may be from about 2 to about 15 microns in thickness. In one embodiment, the first layer is from about 5 microns to about 15 microns in thickness and the second layer total thickness can be from about 10 microns to about 35 microns in thickness.

In the illustrated embodiment, the thickness of the first layer 22 is less than that of the second layer 24. For example, the ratio of the thickness of the second layer 24 to that of the first layer 22 can be, for example, at least about 1.2:1 and in one embodiment, at least 1, 5:1 and in another embodiment, at least about 1.8:1. The ratio can be up to about 10:1, or higher. As noted above, the higher ratios are particularly suited to cases where the concentration ratio is high.

Layer 26 is spaced from the charge generating layer 18 by the layers 22 and 24. Layer 24 is thus sandwiched between layers 22 and 26, with layer 26 providing the upper surface 34 of the charge transport layer 20. Layer 26 may be in contiguous contact with layer 24, or where several layers 24 are employed, with the uppermost layer 24.

Layer 26 may be similarly formed to layers 22 and 24 in that it contains a charge transport component, such as that used for layers 22 and 24, or a different charge transport component, which may be any suitable charge transport component useful as an additive molecularly dispersed in an electrically inactive polymeric material to form a solid solution and thereby making this material electrically active. The third layer 26 has a concentration of the charge transport component which can be higher or lower or about the same as the concentration in the layer 24. In the exemplary embodiment, the third layer (or region) 26 has a lower concentration of the charge transport component than the layer 24. The charge mobility in layer 26 may thus be lower than in layer 24. For example, the concentration of the charge transport component in the third layer can be from about 1% to about 95% of the concentration of the charge transport component in the second layer (or from about 1% to about 95% of the highest concentration in layer 24, where the concentration varies in layer 24). In one embodiment the charge transport component concentration in the third layer is at least about 5% of that of the second layer 24, in another embodiment, at least about 20%, and in yet another embodiment, at least 30%. In one embodiment the charge transport component concentration in the third layer 26 is less than about 90% of that of the second layer, in another embodiment, less than about 80%, and in yet another embodiment, about 60% or less of that of the second layer. In one embodiment, the concentration of the charge transport component in the third layer (or region) 26 is from about 10% to about 80% of the peak concentration of the charge transport component. The charge transport component concentration in the third layer can be approximately the same or somewhat higher or lower than that of the first layer, for example, from about 50% to about 300% of the concentration in the first layer. The concentration of the charge transport component in the charge transport layer 20, in this embodiment, thus increases with distance from the charge generation layer 18 and then decreases again towards the upper surface of the charge transport layer.

The thickness of the third layer 26 can be less than the thickness of the second layer and can be from about 2 microns to about 10 microns.

The third layer 26, may comprise, for example, at least about 5 weight percent and may comprise up to about. 50 weight percent of charge transport component, e.g., from about 5 to about 45 wt %.

In one exemplary embodiment, the charge transport layer includes a layer 22 which comprises 10-35% by weight mTBD, a layer 24 which comprises 40-60% mTBD and optionally a layer 26 which comprises 5-50% mTBD as the charge transport component. In this embodiment, layer 22 may be about 10 microns in thickness layer 24 about 20 microns in thickness and layer 26 about 10 microns in thickness. However it is understood that the thickness of the layers 22, 24, 26 can vary and that layers 22 and 24 can even be equal in thickness. An exemplary charge transport layer formed according to FIG. 1 may have a first layer 22 comprising about 30% mTBD as the charge transport component and a second layer 24, of greater thickness than the first layer 22, comprising about 50% mTBD as the charge transport component, and a third layer comprising less than 50% mTBD, e.g., about 40% or less.

In another exemplary embodiment, layer 22 comprises 5-10% by weight mTBD and layer 24 comprises 20-60% mTBD. in this embodiment, layer 22 may be about 8 microns in thickness and layer 24 about 22 microns in thickness.

Another exemplary charge transport layer formed according to FIG. 1 may have a first layer 22 comprising about 20% mTBD as the charge transport component, a second layer 24, of greater thickness than the first layer 22, comprising about 55% mTBD as the charge transport component, and a third layer 26, of lower thickness than the second layer, comprising about 30% mTBD as the charge transport component.

Figure 2:
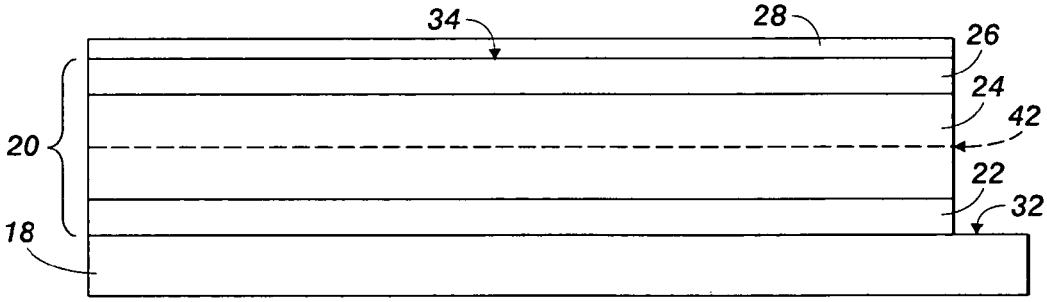
FIG. 2 is a schematic cross sectional view of upper layers of an exemplary imaging member according to a second embodiment.

In another embodiment of an imaging member, illustrated in FIG. 2, which can be similarly configured to the embodiment of FIG. 1, except with respect to the charge transport layer 20, the concentration of the charge transport component increases away from the charge generation layer 18 and reaches a peak concentration value intermediate the upper and lower surfaces of the charge transport layer 20. In this embodiment, the layers 22, 24, 26 are in the form of contiguous regions of gradually changing concentration. The concentration change may be a continuous increase and then decrease as illustrated in the graph of concentration vs. depth adjacent the charge transport layer of FIG. 2, or a more stepwise increase and decrease. The concentration can range for example, from about 2-8% (or whatever level is sufficient to permit at least some charge migration from the surface 32 into the charge transport layer) at or adjacent the surface 32 up to about 40-90%, e.g., about 50% at the peak 42, and drop to about 2-8% at or adjacent the surface 34 (or whatever level is sufficient to permit at least some charge migration to the surface 34).

Figure 3:
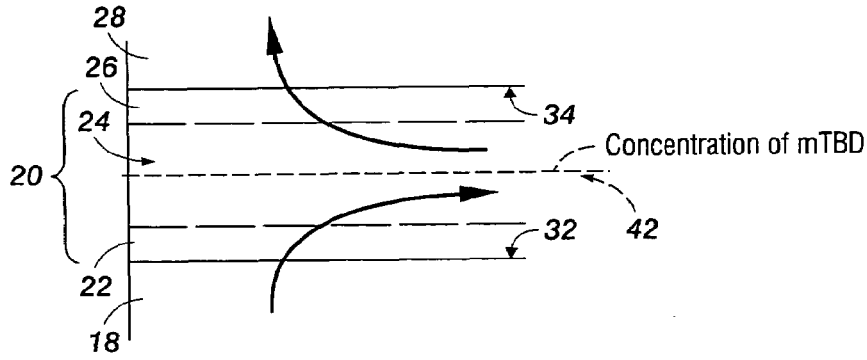
FIG. 3 shows the concentration of charge transport component through layer 20 of FIG. 2.
Figure 4:
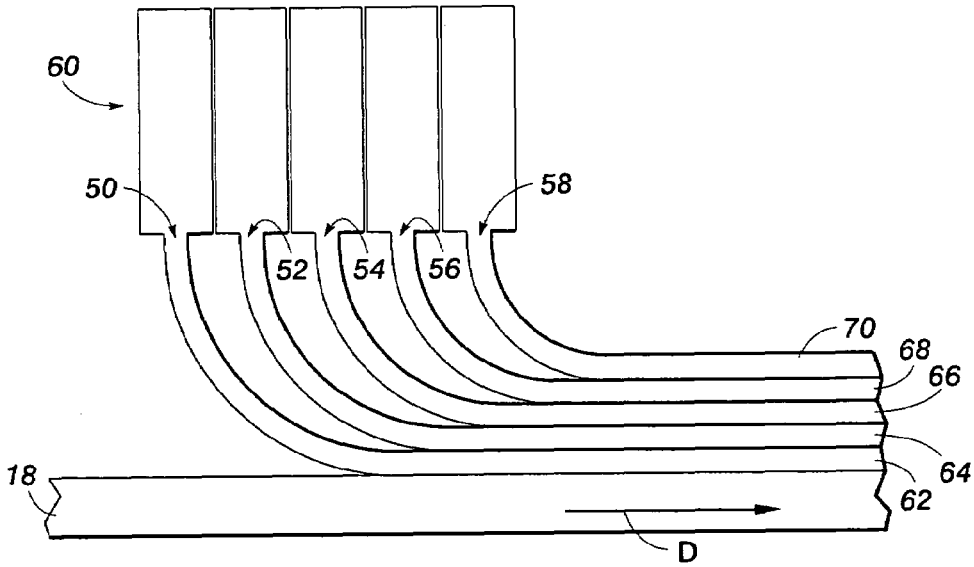
FIG. 4 is a schematic illustration of a slotted dye in process of forming sub-layers of a charge transport layer of an exemplary imaging member.

The charge transport layer 20 of FIG. 2 may be formed by sequential deposition of multiple sub-layers on the charge generation layer 18. For example, there may be from three to about 15 sublayers, such as three, five, six, eight, or more sub-layers. In one embodiment, the sub-layers are not dried or are only partially dried prior to application of the subsequent sub-layer. As a result, partial mixing occurs at the boundaries between the sub-layers and/or diffusion of the charge transport component across the boundary between the sub-layers, and a more gradual variation, rather than step wise variation, in concentration of the charge transport component is achieved. For example, the solutions of different concentrations are deposited via slots 50, 52, 54, 56, 58, etc. in a slotted extrusion die 60, as illustrated in FIG. 4 to form sub-layers 62, 64, 66, 68, 70, respectively on charge generation layer 18 as the imaging member moves relative to the die 60 in the direction of arrow D. Slots 50, 52, and 54, are arranged in a subsequent fashion so that slot 50 carries a solution of low (or zero) concentration of charge transport component which is extruded directly over the dried charge generation layer 18, while slots 52 and 54 each extrude a solution of increasing charge transport component concentration, which dispense each subsequent wet coating sub-layer on top the respective prior wet coating sub-layer as the imaging member web stock is moving in the direction of arrow D. The slots 56 and 58 extrude a solution of decreasing charge transport component concentration. Each subsequent sub-layer is applied while the preceding sub-layer in a partially dried state (which may be defined as containing solvent of not less than 5 weight percent). This arrangement and process promotes the interfacial charge transport component diffusion and leads to final convergence of these layers into a merging, charge transport layer 20, containing an ascending and then descending charge transport component concentration gradient profile in the resulting dried charge transport layer 20 shown in FIG. 3. The highest concentration is intermediate the bottom and the top sub-layers 62, 70, such as in one or more of sub-layers 64, 66, and 68, which define(s) the intermediate region 24. Alternatively, the charge transport layer coating application can be accomplished through utilizing multiple coating dies that yield a similar result.

It will be appreciated that while five sub-layers are illustrated in FIG. 4, fewer or more than five sub-layers may be employed. The slots 50, 52, 54, 56, 58, 60 may be spaced to allow partial drying, through solvent evaporation, prior to application of the subsequent layer. Alternatively, a heater or heaters may be positioned adjacent the sub-layers to assist in drying. Where the lowermost sub-layer 62 is relatively thin, such as from about 2 micrometers to about 20 micrometers when dry, e.g., from about 10 to about 15 micrometers, the concentration of the charge transport component in the solution applied may be zero or close to zero (i.e., the first layer, when deposited, is substantially free of charge transport components). Charge transport component migration from the subsequently applied second sub-layer 64 into this thin layer 62 provides sufficient charge transport component to permit charge migration through the layer 62, once dried. It will be appreciated that in use, the sub-layer 62 contains at least a minimum concentration of charge transport component sufficient to effect movement of charge (holes) through the sub-layer. In a similar way, concentration of the charge transport component in the solution applied to form the top sub-layer 70 may be zero or close to zero as it is extruded through slot 58. Charge transport component migration from the partially-dried, previously-applied sub-layer 68 into the thin layer 70 provides sufficient charge transport component in sub-layer 70 to permit charge migration through the sub-layer 70, once dried. A similar approach may be employed in the embodiment of FIGS. 1 and 2, where, if the lowermost layer 22 is applied as a thin enough layer, it can contain little or no charge transport component since migration of the charge transport component from layer 24 into the partially dried layer 22 provides sufficient charge transport component to permit charge migration through the layer 22, once dried.

The thickness of the first or bottom charge transport sub-layer 62, when dried, can be from about 0.5 to about 10 micrometers, e.g., about 3-7 micrometers. The subsequent sub-layers may have a similar thickness or a greater or lesser thickness, depending on the number of sub-layers employed. The overall thickness of the charge transport layer 20 can be from about 5 micrometers to about 200 micrometers and is generally from about 10 to about 40 microns and more specifically from 20 to 35 microns.

If desired, the composition of the top charge transport layer 26 in each of the photoreceptors described in the above embodiments may also include, for example, additions of antioxidants, leveling agents, surfactants, wear resistant fillers such as dispersion of polytetrafluoroethylene (PTFE) particles and silica particles, light shock resisting or reducing agents, and the like, to impart further photo-electrical, mechanical, and copy print-out quality enhancement outcomes, particularly if no overcoat layer 28 is used.

CDS's are suppressed by the layer 22 while the lower concentration of the charge transport component in the top layer 26 near the exposed surface reduces problems arising from corona effluents and solvents in the surrounding atmosphere, such as cracking and lateral charge migration (LCM). Charge transport components, such as mTBD tend to be oxidized by these effluents. Thus, a lower concentration in the upper layer 40 mitigates these effects, Additional aspects relate to the inclusion in the charge transport layer 20 of variable amounts of an antioxidant, such as a hindered phenol. Exemplary hindered phenols include octadecyl-3,5-di-tert-butyl-4-hydroxyhydrociannamate, available as IRGANOX™ I-1010 from Ciba Specialty Chemicals. The hindered phenol may be present at about 10 weight percent based on the concentration of the charge transport component. The hindered phenol concentration may be is tailored to produce a continuum of varying concentration of the antioxidant in reversal to that of the charge transport component for improved electrical stability and minimization of LCM impact.

Additional aspects relate to inclusion in the upper layer of the charge transport layer or to an overcoat layer 28 of nano particles as a dispersion, such as silica, metal oxides, ACUMIST™ (waxy polyethylene particles), PTFE, and the like. The nanoparticles may be used to enhance the lubricity and wear resistance of the charge transport layer 20. The particle dispersion concentrated in the top vicinity of the upper region of charge transport layer 20 can be up to about 10 weight percent of the weight of the top region or one tenth thickness of the charge transport layer 20 to provide optimum wear resistance without causing a deleterious impact on the electrical properties of the fabricated imaging member.

The charge transport layer 20 is an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer 20 to the charge generator layer 18 is maintained from about 2:1 to about 200:1 and in some instances as great as about 400:1.

In one specific embodiment, the charge transport layer 20 is a solid solution including a charge transport component, such as mTBD, molecularly dissolved in a polycarbonate binder, the binder being either a poly(4,4'-isopropylidene diphenyl carbonate) or a poly(4,4'-diphenyl-1,1'-cyclohexane carbonate). The charge transport layer may have a Young's Modulus in the range of from about 2.5×1 psi (1.7×1 Kg/cm$^2$) to about 4.5×10$^5$ psi (3.2×10$^4$ Kg/cm$^2$) and a thermal contraction coefficient of between about 6×10$^{-5}$% C and about 8×10$^{-5}$/° C.

Where an overcoat layer 28 is employed, it may comprise a similar resin used for the charge transport layer or a different resin and be from about 1 to about 2 microns in thickness.

Since the charge transport layer 20 can have a substantial thermal contraction mismatch compared to that of the substrate support 10, the prepared flexible electrophotographic imaging member may exhibit spontaneous upward curling due to the result of larger dimensional contraction in the charge transport layer 20 than the substrate support 10, as the imaging member cools down to room ambient temperature after the heating/drying processes of the applied wet charge transport layer coating. An anti-curl back coating 32 can be applied to the back side of the substrate support 10 (which is the side opposite the side bearing the electrically active coating layers) in order to render flatness.

The anti-curl back coating 32 may include any suitable organic or inorganic film forming polymers that are electrically insulating or slightly semi-conductive. The anti-curl back coating 32 used has a thermal contraction coefficient value substantially greater than that of the substrate support 10 used in the imaging member over a temperature range employed during imaging member fabrication layer coating and drying processes (typically between about 20° C. and about 130° C.). To yield the designed imaging member flatness outcome, the applied anti-curl back coating has a thermal contraction coefficient of at least about 1.5 times greater than that of the substrate support to be considered satisfactory; that is a value of at least approximately 1×10$^{-5}$/° C. greater than the substrate support, which typically has a substrate support thermal contraction coefficient of about 2×10$^{-5}$/° C. However, an anti-curl back coating with a thermal contraction coefficient at least about 2 times greater, equivalent to about 2×10"$^5$/° C. greater than that of the substrate support is appropriate to yield an effective anti-curling result. The applied anti-curl back coating 32 can be a film forming thermoplastic polymer, being optically transparent, with a Young's Modulus of at least about 2×10$^5$ psi (1.4×10$^4$ Kg/cm$^2$), bonded to the substrate support to give at least about 15 gms/cm of 180° peel strength. The anti-curl back coating 32 may be from about 7 to about 20 weight percent based on the total weight of the imaging member, which may correspond to from about 7 to about 20 micrometers in dry coating thickness. The selected anti-curl back coating is readily applied by dissolving a suitable film forming polymer in any convenient organic solvent.

Exemplary film forming thermoplastic polymers suitable for use in the anti-curl back coating include polycarbonates, polystyrenes, polyesters, polyamides, polyurethanes, polyarylethers, polyarylsulfones, polyarylate, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, combinations thereof, and the like. These polymers may be block, random or alternating copolymers. Molecular weights can vary from about 20,000 to about 150,000. Suitable polycarbonates include bisphenol A polycarbonate materials, such as poly(4,4'-isopropylidene-diphenylene carbonate) having a molecular weight of from about 35,000 to about 40,000, available as LEXAN 145™ from General Electric Company and poly(4,4'-isopropylidene-diphenylene carbonate) having a molecular weight of from about 40,000 to about 45,000, available as LEXAN 141™ also from the General Electric Company. A bisphenol A polycarbonate resin having a molecular weight of from about 50,000 to about 120,000, is available as MAKROLON™ from Farbenfabricken Bayer A.G. A lower molecular weight bisphenol A polycarbonate resin having a molecular weight of from about 20,000 to about 50,000 is available as MERLON™ from Mobay Chemical Company. Another suitable polycarbonate is poly(4,4-diphenyl-1,1'-cyclohexene carbonate), which is a film forming thermoplastic polymer comprising a structurally modified from bisphenol A polycarbonate which is commercially available from Mitsubishi Chemicals. All of these polycarbonates have a Tg of between about 145° C. and about 165° C. and with a thermal contraction coefficient ranging from about 6.0×10$^{-5}$/° C. to about 7.0×10$^{-5}$/° C.

Furthermore, suitable film forming thermoplastic polymers for the anti-curl back coating 32, if desired, may include the same binder polymers used in the charge transport layer 20. The anti-curl back coating formulation may include a small quantity of a saturated copolyester adhesion promoter to enhance its adhesion bond strength to the substrate support. Typical copolyester adhesion promoters are VITEL™ polyesters from Goodyear Rubber and Tire Company, MOR-ESTER™ polyesters from Morton Chemicals, Eastar PETG™ polyesters from Eastman Chemicals, and the like. To impart optimum wear resistance as well as maintaining the coating layer optical clarity, the anti-curl layer may further incorporate in its material matrix, about 5 to about 30 weight percent filler dispersion of silica particles, TEFLON™ particles, $PVF_2$ particles, stearate particles, aluminum oxide particles, titanium dioxide particles or a particle blend dispersion of TEFLON™ and any of these inorganic particles. Suitable particles used for dispersion in the anti-curl back coating include particles having a size of between about 0.05 and about 0.22 micrometers, and more specifically between about 0.18 and about 0.20 micrometers.

In one embodiment, the anti-curl back coating 32 is optically transparent. The term optically transparent is defined herein as the capability of the anti-curl back coating to transmit at least about 98 percent of an incident light energy through the coating. The anti-curl back coating of this embodiment includes a film forming thermoplastic polymer and may have a glass transition temperature (Tg) value of at least about 75° C., a thermal contraction coefficient value of at least about 1.5 times greater than the thermal contraction coefficient value of the substrate support, a Young's Modulus of at least about $2\times10^5$ p.s.i, and adheres well over the supporting substrate to give a 180° peel strength value of at least about 15 g/cm.

The multilayered, flexible electrophotographic imaging member web stocks having the charge transport layer fabricated in accordance with the embodiments described herein may be cut into rectangular sheets. Each cut sheet then brought overlapped at ends thereof and joined by any suitable means, such as ultrasonic welding, gluing, taping, stapling, or pressure and heat fusing to form a continuous imaging member seamed belt, sleeve, or cylinder.

The prepared flexible imaging belt may thereafter be employed in any suitable and conventional electrophotographic imaging process which utilizes uniform charging prior to imagewise exposure to activating electromagnetic radiation, When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

The development will further be illustrated in the following non-limiting examples, it being understood that these examples are intended to be illustrative only and that the disclosure is not intended to be limited to the materials, conditions, process parameters and the like recited herein. All proportions are by weight unless otherwise indicated.

EXAMPLES

In the following Examples, imaging members with two charge transport layers were prepared to demonstrate the reduction in CDS by employing a layer of lower concentration of charge transport molecules adjacent the charge generation layer. It will be appreciated that these imaging members can be prepared with three transport layers or with gradient layers to provide a peak concentration intermediate the surface contacting the charge generation layer and the upper surface of the charge transport layer.

Example 1

An imaging member was prepared by providing a 0.02 micrometer thick titanium layer coated on a biaxially oriented polyethylene naphthalate substrate (KALEDEX™ 2000) having a thickness of 3.5 mils (0.09 millimeters). Applied thereon with a gravure applicator, was a solution containing 50 grams 3-amino-propyltriethoxysilane, 41.2 grams water, 15 grams acetic acid, 684.3 grams of 200 proof denatured alcohol and 200 grams heptane. This layer was then dried for about 2 minutes at 120° C. in the forced air drier of the coater. The resulting blocking layer had a dry thickness of 500 Angstroms.

An adhesive layer was then prepared by applying a wet coating over the blocking layer, using a gravure applicator, containing 0.2 percent by weight based on the total weight of the solution of polyarylate adhesive (ARDEL D100™ available from Toyota Hsutsu Inc.) in a 60:30:10 volume ratio mixture of tetrahydrofuran/monochlorobenzene/methylene chloride. The adhesive layer was then dried for about 2 minutes at 120° C. in the forced air dryer of the coater. The resulting adhesive layer had a dry thickness of 200 Angstroms.

A photogenerating layer dispersion was prepared by introducing 0.45 grams of LUPILON200™ (PC-Z 200) available from Mitsubishi Gas Chemical Corp and 50 ml of tetrahydrofuran into a 100 gm glass bottle. To this solution were added 2.4 grams of hydroxygallium phthalocyanine and 300 grams of ⅛ inch (3.2 millimeter) diameter stainless steel shot. This mixture was then placed on a ball mill for 8 hours. Subsequently, 2.25 grams of PC-Z 200 was dissolved in 46.1 gm of tetrahydrofuran, and added to this OHGaPc slurry. This slurry was then placed on a shaker for 10 minutes. The resulting slurry was, thereafter, applied to the adhesive interface with a Bird applicator to form a charge generation layer having a wet thickness of 0.25 mil (about 6 microns). However, a strip about 10 mm wide along one edge of the substrate web bearing the blocking layer and the adhesive layer, was deliberately left uncoated without any photogenerating layer material, to facilitate adequate electrical contact by the ground strip layer that was to be applied later. The charge generation layer was dried at 120° C. for 1 minute in a forced air oven to form a dry charge generation layer having a thickness of 0.4 micrometers.

This photogenerator layer was overcoated with a first charge transport layer. The first charge transport layer was prepared by introducing into an amber glass bottle in a weight ratio of 20:80 N,N'-diphenyl-N,N'-bis(3-methylphenyl)-1,1'-biphenyl-4,4'-diamine and MAKROLON™ 5705 (a polycarbonate resin having a molecular weight of from about 50,000 to 100,000 commercially available from Farbenfabriken Bayer A.G). The resulting mixture was dissolved in methylene chloride to form a solution containing 15 percent by weight solids. This solution was applied on the photogenerator layer using a Bird applicator to form a coating which upon drying had a thickness of 14.5 microns. During this coating process the humidity was equal to or less than 15 percent.

This first charge transport layer was overcoated with a second charge transport layer. The second charge transport layer was prepared by introducing into an amber glass bottle in a weight ratio of 50:50 N,N'-diphenyl-N,N'-bis(3-methylphenyl)-biphenyl-4,4-diamine and MAKROLON™ 5705. The resulting mixture was dissolved in methylene chloride to form a solution containing 15 percent by weight solids. This solution was applied on the photogenerator layer using a Bird applicator to form a coating which upon drying had a thickness of 14.5 microns. During this coating process the humidity was equal to or less than 15 percent.

Example 2

A photoreceptor was prepared as in Example 1 except in that the first charge transport layer was prepared with N,N'-diphenyl-N,N'-bis(3-methylphenyl)-1,1'-biphenyl-4-4'-diamine and MAKROLON™ 5705 in a weight ratio of 30:70 and the second charge transport layer was prepared with N,N'-diphenyl-N,N'-bis(3-methylphenyl)-1,1'-biphenyl-4,4'-diamine and MAKROLON™ 5705 in a weight ratio of 50:50. The thickness of both layers was the same (14.5 microns).

Example 3

A photoreceptor was prepared as in Example 1 except that the first charge transport layer was prepared with N,N'-diphenyl-N,N'-bis(3-methylphenyl)-1,1'-biphenyl-4,4'-diamine and MAKROLON™ 5705 in a weight ratio of 40:60 and the second charge transport layer was prepared with N,N'-diphenyl-N,N'-bis(3-methylphenyl)-1,1'-biphenyl-4,4'-diamine and MAKROLON™ 5705 in a weight ratio of 50:50. The thickness of both layers was the same (4.5 microns).

Example 4

A photoreceptor was prepared as in Example 1 except that the first charge transport layer was prepared with N,N'-diphenyl-N,N'-bis(3-methylphenyl)-1,1'-biphenyl-4,4'-diamine and MAKROLON™ 5705 in a weight ratio of 50:50 and the second charge transport layer was prepared with a weight ratio of 40:60. The thickness of both layers was the same (14.5 microns).

Example 5

A photoreceptor was prepared as in Example 1 except that the first charge transport layer was prepared with N,N'-diphenyl-N,N'-bis(3-methylphenyl)-1,1'-biphenyl-4,4'-diamine and MAKROLON™ 5705 in a weight ratio of 50:50 and the second charge transport layer was prepared with a weight ratio of 30:70 N,N'-diphenyl-N,N'-bis(3-methylphenyl)-1,1'-biphenyl-4,4'-diamine and MAKROLON™ 5705. The thickness of both layers was the same (14.5 microns).

Example 6

A photoreceptor was prepared as in Example 1 except that the first charge transport layer was prepared with N,N'-diphenyl-N,N'-bis(3-methylphenyl)-1,1'-biphenyl-4,4'-diamine and MAKROLON™ 5705 in a weight ratio of 35:65 and the second charge transport layer was prepared with a weight ratio of 43:57 N,N'-diphenyl-N,N'-bis(3-methylphenyl)-1,1'-biphenyl-4,4'-diamine and MAKROLON™ 5705. The thickness of both layers were the same (14.5 microns).

Example 7 Electrical Scanner

The flexible photoreceptor sheets prepared as described in Examples 1-6 were tested for their xerographic sensitivity and cyclic stability in a scanner. In the scanner, each photoreceptor sheet to be evaluated was mounted on a cylindrical aluminum drum substrate, which was rotated on a shaft. The devices were charged by a corotron mounted along the periphery of the drum. The surface potential was measured as a function of time by capacitatively coupled voltage probes placed at different locations around the shaft. The probes were calibrated by applying known potentials to the drum substrate. Each photoreceptor sheet on the drum was exposed to a light source located at a position near the drum downstream from the corotron. As the drum was rotated, the initial (pre-exposure) charging potential (Vddp) was measured by a first voltage probe. Further rotation lead to an exposure station, where the photoreceptor device was exposed to monochromatic radiation of a known intensity of 3.5 ergs/cm$^2$ to obtain Vbg. The devices were erased by a light source located at a position upstream of charging to obtain Vr. The measurements illustrated in Table 1 below include the charging of each photoconductor device in a constant current or voltage mode. The devices were charged to a negative polarity corona. The surface potential after exposure (Vbg) was measured by a second voltage probe. In the design, the exposure could be turned off in certain cycles. The voltage measured at the second probe is then Vddp. The voltage generally is higher at the charging station. The difference between the charged voltage at the charging station and the Vddp is dark decay. The devices were finally exposed to an erase lamp of appropriate intensity and any residual potential (Vr) was measured by a third voltage probe. After 10,000 charge-erase cycles, the Vbg was remeasured and the difference between Vbg for the first cycle and Vbg for cycle 10,000 (ΔVbg 10K) was computed.

Table 1 shows the concentration of mTBD in each of the charge transport layers after drying for the 6 exemplary sheet configurations along with the measured electrical characteristics described above. First pass is the first layer 22, second pass is the second layer 24.

TABLE 1

| Example | mTBD Concentration in First Pass | mTBD Concentration in Second Pass | Dark Development (3.5 erg Vbg Vddp = 500) | Background AVbg 10K | Residual 300 erg Vr cy30 |
|---|---|---|---|---|---|
| 1 | 20 | 50 | 117 | +46 | 110 |
| 2 | 30 | 50 | 80 | +56 | 52 |
| 3 | 40 | 50 | 65 | +53 | 31 |
| 4 | 50 | 40 | 65 | +52 | 27 |

TABLE 1-continued

| Example | mTBD Concentration in First Pass | mTBD Concentration in Second Pass | Dark Development (3.5 erg Vbg Vddp = 500) | Background AVbg 10K | Residual 300 erg Vr cy30 |
|---|---|---|---|---|---|
| 5 | 50 | 30 | 58 | +45 | 27 |
| 6 | 35 | 43 | 76 | +54 | 45 |

Figure 5:
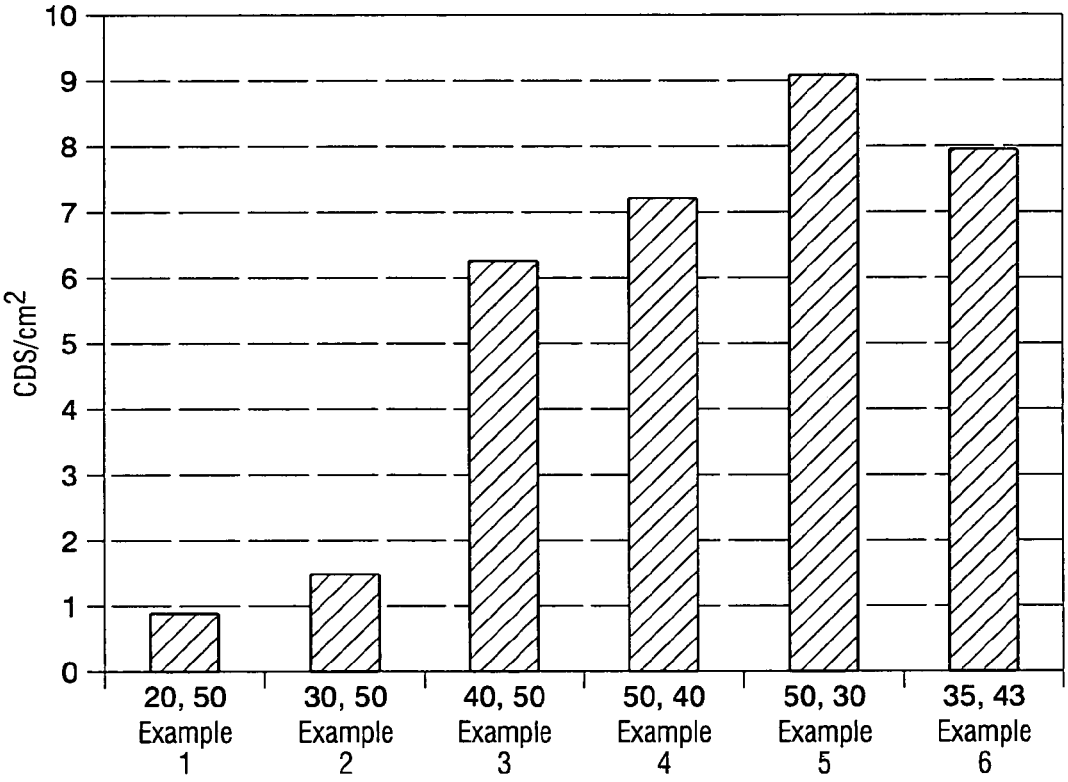
FIG. 5 is a bar graph illustrating the effects of charge transport component concentration on CDS's in a multilayer photoreceptor.

The sheets thus formed were tested with a floating probe scanner (FPS scanner) for CDS in a manner similar to that described in U.S. Pat. No. 6,008,653 and U.S. Pat. No. 6,119,536, incorporated herein by reference. The 23 cm wide and 28 cm long sheets of all the samples were cut and mounted on a drum of the FPS scanner one at a time. The drum was rotated continuously and underwent a sequence of charging under a scorotron to 700 volts. Then measurements of micro defects were made. These consisted of high resolution voltage measurements of 50 to 100 micron resolution by an aerodynamically floating probe which was capacitively coupled to the photoreceptor charged surface. The probe was maintained at a constant distance of 50 microns during the entire scan of the sample surface. After this, the photoreceptor was discharged by an erase lamp before the next cycle started. In each cycle the drum was moved translationally in small steps of 25 to 50 microns. The floating probe scanner then counted the CDS's over an area of about 100 to 150 $cm^2$ and provided an average value/$cm^2$. FIG. 5 shows the results obtained with the floating probe scanner. Table 1 shows the electrical properties.

As can be seen from FIG. 5, the best results for the six examples, in terms of CDS/$cm^2$, were found in Examples 1 and 2, where the first layer (closest to the charge generating layer) had a significantly lower concentration of mTBD than the second layer. Generally a count of 2-3 CDS/$cm^2$ or lower qualifies a belt for release to the field. Thus, even with a charge generation layer selected for its typically high incidence of CDS, sheets suited to practical filed use are achieved.

As evident from Table 1, the reduction in mTBD loading causes the background potential (Vbg) to rise. Examples 1 and 2 (and, by inference, mTBD concentration values between the two) thus provide an imaging member with low CDS and yet which provides good electrical properties. It is also to be expected that by lowering the thickness of the first layer will provide further benefits in terms of electrical properties.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An imaging member comprising:

an electrically conductive support substrate or electrically conductive layer;

a charge generating layer; and a charge transport layer comprising a first surface in contact with the charge generating layer and a second surface, the charge transport layer comprising a film forming polymer binder and a charge transport component dispersed therein, wherein the concentration of the charge transport component in the charge transport layer is at a peak in a region of the charge transport layer intermediate the first and second surfaces of the charge transport layer, the film forming binder being the same throughout the charge transport layer, and wherein the charge transport layer comprises a first layer and a second layer, the first layer being of a lower thickness than the second layer.

2. The imaging member of claim 1, wherein the charge transport component progressively increases in concentration from the first surface and decreases from the peak to the second surface of the charge transport layer.

3. The imaging member of claim 1, wherein the second layer comprises the peak concentration of the charge transport component.

4. The imaging member of claim 1, wherein the first layer is from about 5 microns to about 15 microns in thickness and the second layer is from about 10 microns to about 35 microns in thickness.

5. The imaging member of claim 1, wherein the charge transport component is molecularly dispersed in the film forming polymer to form a solid solution.

6. The imaging member of claim 1, wherein the charge transport component comprises an aryl amine selected from the group consisting of diphenyl diamines, triphenyl amines, terphenyl diamines, and combinations thereof.

7. The imaging member of claim 6, wherein the charge transport component comprises (N,N'-diphenyl-N,N'-bis[3-methylphenyl]-[1,1'-biphenyl]-4,4'-diamine).

8. The imaging member of claim 1, wherein the charge transport component is the same throughout the charge transport layer.

9. The imaging member of claim 1, wherein the charge generating layer comprises a photogenerating material and the charge transport layer is substantially free of photogenerating materials.

10. An imaging member comprising:

an electrically conductive support substrate or electrically conductive layer;

a charge generating layer; and a charge transport layer comprising a first surface in contact with the charge generating layer and a second surface, the charge transport layer comprising a film forming polymer binder and a charge transport component dispersed therein, wherein the concentration of the charge transport component in the charge transport layer is at a peak in a region of the charge transport layer intermediate the first and second surfaces of the charge transport layer, the charge transport layer further comprises a stabilizing hindered phenol and wherein the concentration of the hindered phenol increases in inverse relation to the concentration of the charge transport component towards a surface of the charge transport layer furthest from the charge generation layer.

11. The imaging member of claim 10, wherein the charge transport layer comprises a first layer and a second layer, the first layer being of a lower thickness than the second layer.

12. A method comprising:

forming a charge transport layer on a charge generating layer comprising:

depositing a first layer on the charge generating layer, the first layer comprising a solvent, a film forming polymer binder, and optionally a charge transport component dispersed therein;

prior to complete drying of the first layer, depositing at least one second layer directly or indirectly on the first layer such that the at least one second layer is spaced from the charge generating layer by the first layer, the at least one second layer comprising a film forming polymer binder and a charge transport component dispersed therein, a concentration of charge transport component in the at least one second layer, upon drying, being higher than a concentration of charge transport component in the first layer, the first layer, when deposited, being substantially free of charge transport components and wherein the transport component diffuses from the second layer into the first layer prior to complete drying of the first layer;

optionally depositing a third layer on the at least one second layer, the third layer comprising a film forming polymer binder and optionally a charge transport component dispersed therein, a concentration of charge transport component in the third layer, upon drying, being lower than a concentration of charge transport component in an adjacent second layer; and optionally depositing an overcoat layer over the charge transport layer.

* * * * *